US008979009B2

(12) United States Patent
Solomon et al.

(10) Patent No.: US 8,979,009 B2
(45) Date of Patent: Mar. 17, 2015

(54) CONCRETE CRUSHER

(75) Inventors: Mark Solomon, Orefield, PA (US); K. Chris Littleford, Scotrun, PA (US); Trevor J. Kupstas, Frenchtown, NJ (US)

(73) Assignee: Flsmidth A/S (DK)

( * ) Notice: Subject to any disclaimer, the term of this patent is extended or adjusted under 35 U.S.C. 154(b) by 919 days.

(21) Appl. No.: 12/648,325

(22) Filed: Dec. 29, 2009

(65) Prior Publication Data

US 2011/0155833 A1 Jun. 30, 2011

(51) Int. Cl.

| | |
|---|---|
| ***B02C 15/10*** | (2006.01) |
| ***B02C 2/00*** | (2006.01) |
| ***B02C 2/04*** | (2006.01) |
| ***B02C 2/06*** | (2006.01) |

(52) U.S. Cl.

CPC . *B02C 2/005* (2013.01); *B02C 2/04* (2013.01); *B02C 2/06* (2013.01)

USPC ..... 241/207

(58) Field of Classification Search

CPC ..... B02C 2/04; B02C 2/00

USPC ..... 241/207–216

See application file for complete search history.

(56) References Cited

U.S. PATENT DOCUMENTS

| | | | | | |
|---|---|---|---|---|---|
| 995,044 | A * | 6/1911 | Symons | ..... | 241/208 |
| 1,000,049 | A * | 8/1911 | Symons | ..... | 241/208 |
| 1,016,904 | A * | 2/1912 | Symons | ..... | 241/208 |
| 1,019,997 | A * | 3/1912 | Symons | ..... | 241/208 |
| 1,029,742 | A * | 6/1912 | Oapen | ..... | 241/208 |
| 1,050,398 | A * | 1/1913 | Smith | ..... | 241/208 |
| 1,309,104 | A * | 7/1919 | Sanborn | ..... | 241/208 |
| 1,519,625 | A * | 12/1924 | Munro et al. | ..... | 241/208 |
| 1,656,004 | A * | 1/1928 | Keine | ..... | 241/208 |
| 2,054,326 | A | 9/1936 | Jacobson | | |
| 2,190,036 | A * | 2/1940 | Morch | ..... | 241/156 |
| 2,310,601 | A * | 2/1943 | Rumpel | ..... | 241/208 |
| 2,500,908 | A * | 3/1950 | Symons | ..... | 241/24.13 |
| 2,941,732 | A * | 6/1960 | Cross et al. | ..... | 241/101.3 |
| 4,018,396 | A | 4/1977 | Shoemaker et al. | | |
| 4,588,137 | A * | 5/1986 | McConnell, Jr. | ..... | 241/156 |
| 7,195,186 | B2 * | 3/2007 | Van Mullem | ..... | 241/207 |
| 2002/0170994 | A1 * | 11/2002 | Van Mullem | ..... | 241/207 |

* cited by examiner

*Primary Examiner* — Faye Francis

(74) *Attorney, Agent, or Firm* — Daniel DeJoseph; Aaron M. Pile; Matthew R. Weaver

(57) ABSTRACT

A gyratory crusher, which includes a bowl, a head assembly and a cylindrical eccentric assembly. The bowl is shaped as a cone and has a wider opening approaching a top portion of the crusher, and an inner shell, which is backed by a concrete outer shell. The head assembly is shaped as a cone, and is centrally located within the bowl. The head assembly also includes a central mainshaft which is located on an inclined axis within the bowl. The cylindrical eccentric assembly includes an eccentric central volume in which the main shaft is held so that, as the eccentric assembly rotates, the mainshaft gyrates, with the eccentric assembly rotating about a center hole within a central hub of the crusher. A method of making or retrofitting a crushing device such as, for example, a cone crusher or other gyratory crusher, is also provided.

11 Claims, 2 Drawing Sheets

CONCRETE CRUSHER

FIELD OF INVENTION

The present invention relates to crushing devices and, more particularly, to a design for a concrete crusher, which includes a concrete gyratory shell.

BACKGROUND OF THE INVENTION

Gyratory crushers (or cone crushers) are well established machines that are used for crushing rocks, ore, and other materials. They are very large and their basic structure comprises a bowl shaped as a cone with the wider end of the cone near the top of the crusher. A conical head assembly is located on the axis of the bowl, and the head assembly is oriented so that its smaller dimension is at the top of the crusher. To perform the crushing action, independent motions are applied to the conical head assembly. The first is rotation and the second is gyration.

In the typical gyratory crusher, large material is fed into the top between the large opening of the bowl and the small end of the head assembly where the volume is largest. The gyration of the head assembly is furnished by an eccentric drive, the rotation is driven by a gear, and vertical support and minor vertical adjustment is furnished by a hydraulic support. All these parts are located at the bottom of the crusher at the bottom of the conical head assembly. The combination of the rotation and the gyration applies forces that crush the pieces of material, and they fall lower into the reduced space within the bowl as they are reduced in size. Ultimately the material leaves the crusher through openings at the bottom of the crusher.

A typical gyratory crusher has a thick metal shell that is typically cast. It can be appreciated that these large castings can require long lead times, and a result only a limited number of potential suppliers are available. In addition, the thick metal shell is expensive.

Accordingly, in accordance with an exemplary embodiment, a concrete gyratory shell can be used to replace a significant portion of the casting needed. It can be appreciated that a concrete gyratory shell can replace the thick metal shell, and which is easier to manufacture, at a lower cost and with reduced lead time.

SUMMARY OF THE INVENTION

In accordance with an exemplary embodiment, a gyratory crusher comprises: a bowl shaped as a cone and having a wider opening approaching a top portion of the crusher, and wherein the bowl has an inner shell, which is backed by a concrete outer shell; a head assembly shaped as a cone, centrally located within the bowl and having a larger diameter at a bottom end portion of the bowl, so that the bowl and head assembly form a crushing volume which is larger at the top portion and smaller at the bottom end, with the head assembly including a central mainshaft which is located on an inclined axis within the bowl; and a cylindrical eccentric assembly including an eccentric central volume in which the main shaft is held so that, as the eccentric assembly rotates, the mainshaft gyrates, with the eccentric assembly rotating about a center hole within a central hub of the crusher.

In accordance with another exemplary embodiment, a method of making or retrofitting a gyratory crusher comprises: forming a concrete outer shell shaped as a cone and having a wider opening approaching a top portion of the outer concrete shell; and lining the concrete outer shell with a fabricated form.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of crushing devices, such as gyratory crushers, crushing circuits or cone crushers, and methods of making such devices are shown in the accompanying drawings in which.

DETAILED DESCRIPTION OF PRESENT PREFERRED EMBODIMENTS

Figure 1:
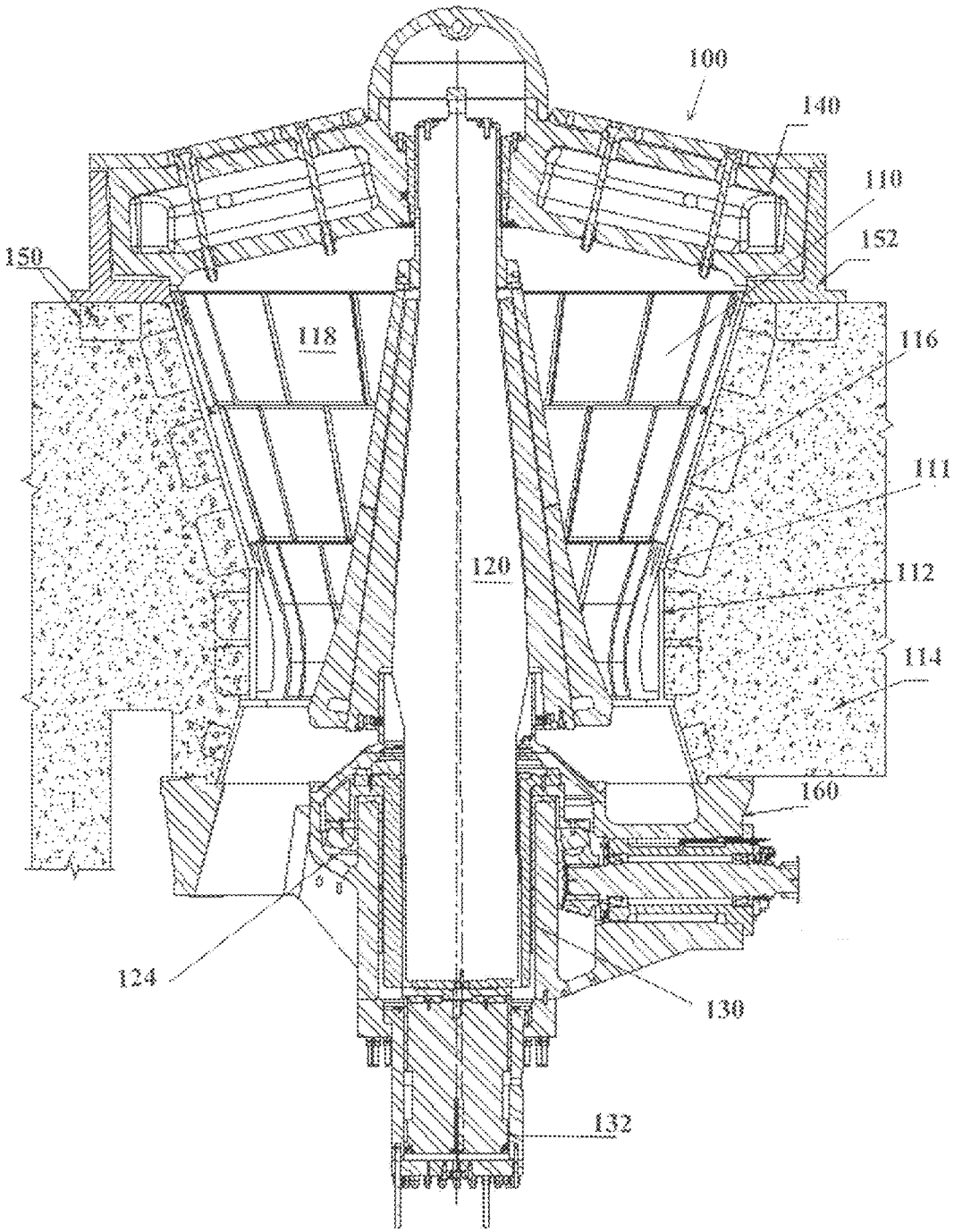
FIG. 1 is a cross sectional view of a concrete gyratory crusher in accordance with an exemplary embodiment.
Figure 2:
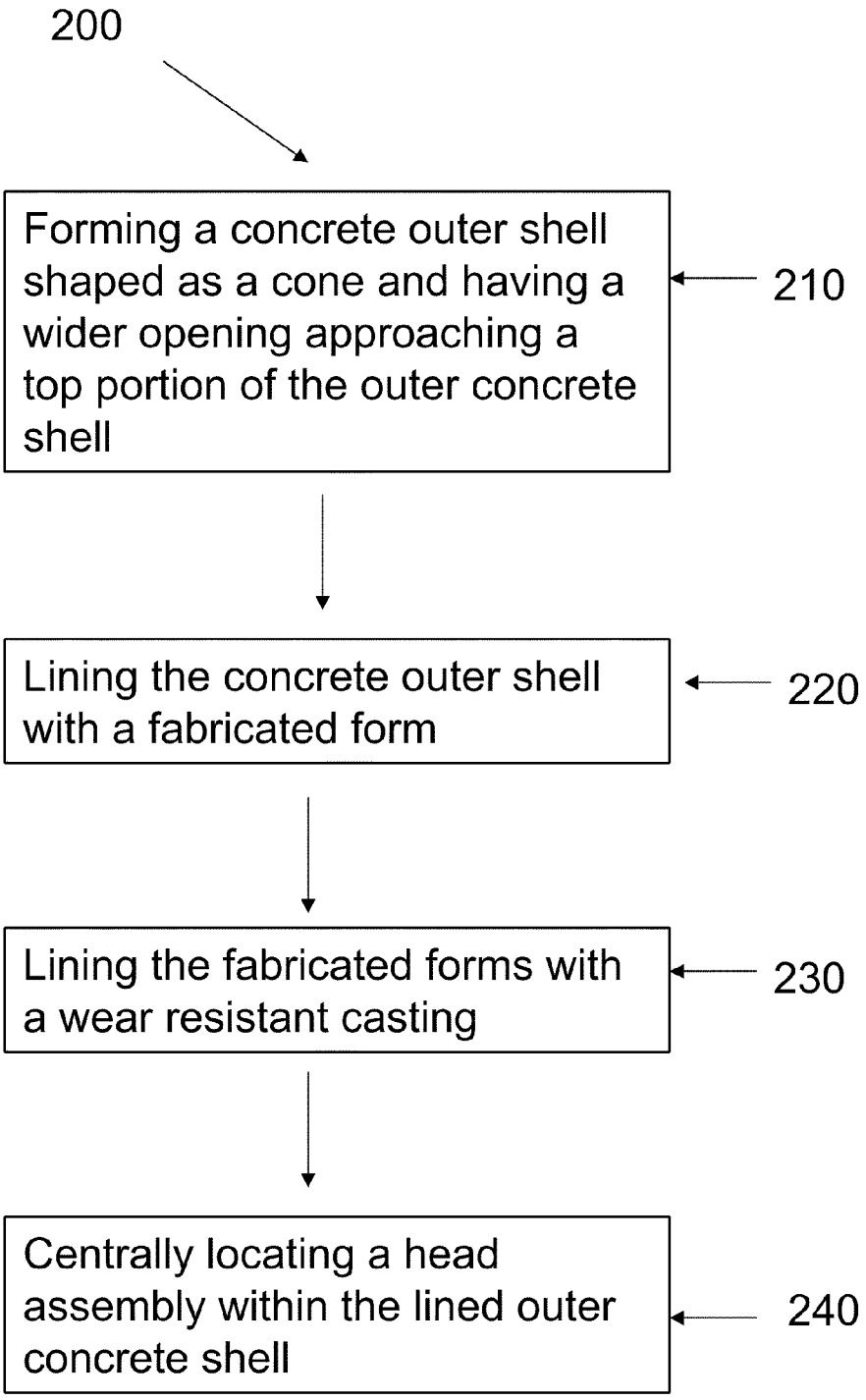
FIG. 2 is a flow chart showing a method of making or retrofitting a gyratory crusher in accordance with an exemplary embodiment.

In accordance with an exemplary embodiment, a gyratory crusher 100 includes a bowl 110 comprised of an inner shell 111, which is backed by a concrete shell 114. In accordance with an exemplary embodiment, the concrete shell 114 is lined with a plurality of fabricated forms 112. In accordance with an exemplary embodiment, the plurality of fabricated forms are a plurality of thin metal plates or shells 116. It can be appreciated that by replacing the outer metal shell or casting with a plurality of thin metal plates (or shells) 116 and an outer concrete shell 114, the bowl 110 of the gyratory shell is easier to manufacture based on the use of concrete or other materials. In addition, the bowl 110 can be manufactured at a lower cost and with reduced lead times. In addition, by using a concrete shell 114 lined with thin metal plates (or shells) 116, the size of the gyratory crusher 110 is also no longer limited to the largest castable shell.

FIG. 1 is a cross sectional view of a preferred embodiment of concrete gyratory crusher 100 in accordance with an exemplary embodiment. As shown in FIG. 1, the concrete gyrator crusher 100 includes bowl or shell 110 shaped as a cone with its wider opening at the top, and head assembly 120 which is located on the axis of bowl 110. The head assembly 120 is shaped as a cone and has its larger diameter at the lower end of bowl 110 so that together the bowl 110 and the head assembly 120 form crushing volume, which is larger at the top and smaller at the lower end. This configuration permits larger material to be fed into the top of crusher 100, and which falls to the bottom of bowl 110 as it is crushed into smaller pieces and exits the crusher 100. Typically, both the bowl 110 and the head assembly 120 have replaceable working surfaces. The bowl 110 has a liner (not shown), called a "concave" in the industry, and head assembly 120 has a liner (not shown) referred to as a "mantle".

In accordance with an exemplary embodiment, the head assembly 120 is located adjacent to an eccentric assembly 130 which is rotated by a ring gear 124. The eccentric assembly 130, within which the lower portion of a mainshaft 134 is held, imparts to the head assembly 120 an eccentric motion, essentially a gyration, for the crusher 100 to function. The motion is imparted to the head assembly 120 by the eccentric assembly 130 that has an eccentric center volume, although the eccentric assembly 130 is itself cylindrical and mounted in a centered cylindrical support hole within a center hub. The eccentric assembly 130 along with annular shell 132, are part of the bottom support structure of crusher 100. The eccentric assembly 130 rotates about a center hole and, as eccentric assembly 130 rotates, its eccentric center volume moves the bottom end of mainshaft in an eccentric path imparting the gyratory motion to head assembly 120.

The mainshaft 134 of the head assembly 120 fits into and is attached to the eccentric assembly 130, and, at the top of the crusher 100, the mainshaft 134 is located by bushings or bearings within a spider (or spider device) 140. The spider (or spider device) 140 is the upper support member of the crusher 100. The eccentric assembly 130 and the mainshaft 134 are supported from below the eccentric assembly 130 by a hydraulic support assembly 132. The hydraulic support assembly 132 is typically comprised of a cylindrical support and a piston assembly.

In accordance with an exemplary embodiment as shown in FIG. 1, the bowl (or shell) 110 is comprised of a plurality of prefabricated (or fabricated) forms 112, which are preferably in the form of a thin metal shells or plates 116. The plurality of prefabricated forms 112 are backed with a concrete outer shell 114 for support. The fabricated forms 112 also can include an anchor or other means of attaching to the fabricated forms 112 to the concrete outer shell 114. In addition, the fabricated forms 112 are preferably lined with wear resistant castings (or concaves) 118.

In accordance with an exemplary embodiment, the thin metal shell or plates 116 are preferably rolled metal plates. However, it can be appreciated that other types of metal shells or plates 116 and/or metal working can be used. The thin metal plates and/or shells 116 preferably have a thickness of approximately 0.01 to 6 inches. It can be appreciated that one of the benefits of a concrete outer shell or bowl 110 is that the manufacturing of the bowl 110 including the concrete outer shell 112 and the thin metal shell or plates 116 is not limited to large cast facilities, but can be performed local to the installation. In addition, by providing an outer concrete shell 114, the concrete reduces the noise level of the crusher during operation.

In accordance with another exemplary embodiment, the concrete outer shell 114 can be manufactured in a plurality of sub-assemblies or parts, which are assembled on location using a grout or other material to hold the plurality of sub-assemblies together to form a concrete bowl 110. It can be appreciated that the concrete outer shell 114 is designed to allow access to the maintenance points of the bottom shell or portion of the crusher 110, including the head assembly 120 and the eccentric assembly 130.

In accordance with an exemplary embodiment, the concrete outer shell 114 can include an optional grout material, which provides additional support to the concrete gyratory crusher 100. In accordance with an exemplary embodiment, an intermediate epoxy and/or backing material can also be injected or other wise applied to the thin metal plates or shells 116 to enhance and/or ensure good adhesion or contact between the thin metal plates or shells 112 and the supporting material (i.e., concrete outer shell 114). The epoxy and/or backing material can also be used to fill any voids that may be present in the supporting material (i.e., concrete outer shell 114).

The bowl 110 also preferably includes a plurality of reinforcement bars 150, which are embedded within the concrete shell 114 to provide added support to the concrete shell 114. The plurality of reinforcement bars 150 are preferably embedded with the concrete shell 114 along an inner edge or surface of the concrete outer shell 114, and extend from the top portion (or upper portion) to a lower portion (or bottom portion) of the bowl 110.

In addition, the top portion of the bowl 110 also includes a spider pocket and a top metal flange 152, and which is embedded on the top end of the crusher 100 with provisions to fix the spider (or spider device) 140. The head assembly 120 also includes a bottom shell 160, which is embedded directly into the concrete outer shell 114. In accordance with an exemplary embodiment, the bottom shell 160 is preferably a two arm bottom shell 160, which is mount and/or embedded within the concrete shell 114 to provide additional reinforcement to the concrete gyratory crusher 100.

In accordance with an exemplary embodiment, a method of making or retrofitting a gyratory crusher 200 comprises the steps of forming a concrete outer shell shaped as a cone having a wider opening approaching a top portion of the outer concrete shell 210, and lining the concrete outer shell with a fabricated form 220. The method also includes lining the fabricated forms with a wear resistant casting 230. A head assembly is centrally located within the lined outer concrete shell 240.

It should be understood that a customer may be provided with a gyratory crusher such as a cone crusher in one sale. Thereafter, a customer may be told of a method of retrofitting that cone crusher or other gyratory crusher to form, a cone crusher that includes a bowl comprised of an inner shell or lining and an outer concrete shell member. Such a retrofitted cone crusher or other gyratory crusher may be similar to the embodiment shown in FIG. 1. The inner shell (or lining) and/or outer concrete shell member may be provided by a supplier or may be purchased from the vendor that previously sold the customer the gyratory crusher. It is contemplated that the vendor or the customer may perform the retrofitting.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed is:

1. A gyratory crusher comprising:

a bowl shaped as a cone and having a wider opening approaching a top portion of the crusher, and wherein the bowl has an inner shell, which is backed by a concrete outer shell;

a head assembly shaped as a cone, centrally located within the bowl and having a larger diameter at a bottom end portion of the bowl, so that the bowl and head assembly form a crushing volume which is larger at the top portion and smaller at the bottom end, with the head assembly including a central mainshaft which is located on an inclined axis within the bowl; and a cylindrical eccentric assembly including an eccentric central volume in which the main shaft is held so that, as the eccentric assembly rotates, the mainshaft gyrates, with the eccentric assembly rotating about a center hole within a central hub of the crusher.

2. The crusher of claim 1, wherein the inner shell is comprised of a plurality of fabricated forms, which are sized and configured to be attachable to the concrete outer shell.

3. The crusher of claim 1, wherein the inner shell is comprised of a plurality of metal sheets, which are sized and configured to be attachable to the concrete outer shell.

4. The crusher of claim 3, wherein the plurality of metal sheets are rolled metal plates.

5. The crusher of claim 1, further comprising a plurality of reinforcement bars embedded within the concrete outer shell.

6. The crusher of claim 1, further comprising a metal flange on an upper portion of the concrete outer shell, which is sized and configured to receive a spider device.

7. The crusher of claim 6, further comprising a spider device located at the top of the crusher functioning as the upper support member of the crusher and including bushings or bearings within which an upper portion of the mainshaft is captured.

8. The crusher of claim 1, further comprising a bottom shell which is attached to the concrete structure.

9. The crusher of claim 8, wherein the bottom shell is part of or imbedded in the concrete outer shell.

10. The crusher of claim 1, further comprising an epoxy and/or backing material, which is applied between the inner shell and the outer concrete shell.

11. The crusher of claim 1, further comprising a gear sized and configured to rotate the eccentric assembly.

* * * * *